US005996491A

United States Patent [19]

Kishine et al.

[11] Patent Number: 5,996,491

[45] Date of Patent: Dec. 7, 1999

[54] TURN BAR APPARATUS

[75] Inventors: Toshiaki Kishine; Ryoichi Kanno, both of Chiba-ken, Japan

[73] Assignee: Miyakoshi Printing Machinery Co., Ltd., Narashino, Japan

[21] Appl. No.: 09/070,880

[22] Filed: May 1, 1998

[30] Foreign Application Priority Data

May 7, 1997 [JP] Japan ..... 9-116985

[51] Int. Cl.[6] ..... B41F 5/04

[52] U.S. Cl. ..... 101/223; 101/222; 101/228; 226/40; 226/42; 226/111; 226/178

[58] Field of Search ..... 101/220, 222, 101/223, 229; 226/40, 178, 186, 44, 42, 111, 188, 197; 242/471

[56] References Cited

U.S. PATENT DOCUMENTS

| | | | |
|---|---|---|---|
| 2,884,856 | 5/1959 | Brodie | 101/179 |
| 3,206,089 | 9/1965 | Huck | 226/40 |
| 3,906,855 | 9/1975 | Laursen | 101/223 |
| 4,007,866 | 2/1977 | Traise | 226/30 |
| 4,011,975 | 3/1977 | Brown, Jr. | 226/2 |
| 4,341,335 | 7/1982 | Schmid | 226/195 |
| 4,654,567 | 3/1987 | Kajikawa et al. | 346/134 |
| 4,779,783 | 10/1988 | Fischer et al. | 226/168 |
| 5,337,944 | 8/1994 | Shiba | 226/108 |

OTHER PUBLICATIONS

"Offset Press", (Mechanism of Machine and Correct Operation), edited by Mitsubishi Jyukogyo Mihara Seisakusho, printed by Nippon Insatsu Shimbun–sha, Sep. 10, 1992.

*Primary Examiner*—Ren Yan
*Assistant Examiner*—Dave A. Ghatt
*Attorney, Agent, or Firm*—Wenderoth, Lind & Ponack, L.L.P.

[57] ABSTRACT

A turn bar apparatus is incorporated in a rotary press for reversing a web position during running thereof. The turn bar apparatus includes an upstream side turn bar, and a downstream side turn bar disposed along a web running direction. Pull rollers are disposed on an upstream side and a downstream side of the upstream side and downstream side turn bars, respectively. The puller rollers are controlled in such a manner that the peripheral speeds of the pull rollers are faster than a running speed of the web.

4 Claims, 9 Drawing Sheets

TURN BAR APPARATUS

BACKGROUND OF THE INVENTION

1. Technical Field

The present invention relates to a turn bar (angle bar) apparatus of a rotary press used for back printing of a web or film and moving a continuous web paper for the rotary press.

2. Background Art

A conventional turn-bar apparatus A of this type is shown in FIG. 1, and the turn bar apparatus A is generally composed of an upstream side turn bar 1, a downstream side turn bar 2, an upstream side guide roller 3 disposed on an upstream side of the upstream side turn bar 1, a downstream side guide roller 4 disposed on a downstream side of the downstream side turn bar 2, and an intermediate roller 5 disposed between the turn-bars 1 and 2 at the side portion thereof. A web such as paper or film is engaged with and run through the upstream side guide roller 3, the upstream side turn bar 1, the intermediate roller 5, the downstream side turn bar 2 and the downstream side guide roller 4, in this order. During this running, the front and back surfaces of the web 6 is turned over and a tension is applied between the turn bars 1 and 2 is adjusted by the intermediate roller 5. Reference numeral 7 denotes an auxiliary guide roller.

Printing units, not shown, are disposed both upstream and downstream sides of the turn bar apparatus of the structure mentioned above.

In the turn bar apparatus A of the above structure, however, both the turn bars 1 and 2 are stationarily arranged, and the web 6 slidably runs along the surfaces of these turn bars 1 and 2. According to such structure, a running resistance at portions of these turn bars increases, which results in a large difference in tensions acting on the web 6 at inlet and outlet portions of the turn bar apparatus A. Moreover, the running resistance to the running web is not constant and the tension is hence changed. As a result, registerings of the printing units may be aberrant at the upstream and downstream sides.

In order to reduce such running resistance, in the conventional turn bar apparatus A, the turn-bars 1 and 2 are formed so as to have inner hollow structures having a plurality of fine holes formed to portions of the turn bars around which the web 6 is wound up, and air is blown out through these fine holes so that the web 6 floats above the surfaces of the turn bars 1 and 2 and runs in the floating state. In this structure, however, the positional accuracy of the web 6 is adversely affected by the air blowing strength and the registering accuracy at the printing operation is also adversely affected.

In another way for reducing the running resistance, in the conventional turn bar apparatus, a glass-bead bonded sheet, or high polymer plastic sheet having a good sliding performance, may be wound up around the surfaces of the turn bars 1 and 2. In this structure, the running resistance is not sufficiently reduced and such sheets have insufficient durability, thus also providing a problem.

In a further way of reducing the running resistance, the intermediate roller 5 may be formed so as to be freely or forcibly rotatable in the web running direction. In such a structure, however, when an intermediate roller 5 rotated with a constant speed by a driving device is used, the tension will be changed in a case where webs having different thicknesses run, resulting in a problem of degrading the registering performance at the printing operation.

SUMMARY OF THE INVENTION

An object of the present invention is to substantially eliminate defects or drawbacks encountered in the prior art devices described above and to provide a turn bar apparatus for a rotary press capable of preventing the tension of a web from varying during the running thereof caused due to a running resistance of the web.

This and other objects can be achieved according to the present invention by providing a turn bar apparatus for a rotary press for reversing a web in position during running. The apparatus includes:

- a pair of upstream side and downstream side turn bars disposed in the web running direction; and
- a pair of pull rollers disposed upstream side and downstream side of the turn bars respectively and adapted to pull the web so that peripheral speeds of the pull rollers become faster than a running speed of the web.

In a preferred embodiment of the aspect mentioned above the pull rollers are connected to a prime motive shaft by means of speed reduction mechanisms, respectively, and the speed reduction mechanisms may be composed of gear arrangements.

The pull rollers are connected to a prime motive shaft through differential speed changing mechanisms respectively which are minutely changeable in speeds through rotations of servo-motors. The turn bar apparatus further comprises tension detectors for detecting tensions of the web at upstream sides of the pull rollers in the web running direction and a control means connected to the tension detectors and adapted to control the serve-motors so that rotational speeds of the pull rollers are controlled in response to signals detected by the tension detectors.

In a modification, only the upstream side pull roller is connected to a prime motive shaft through a differential speed changing mechanism which is minutely changeable in a speed through rotation of corresponding one of the servo-motor. The turn bar apparatus further comprises a tension detector for detecting tension of the web at an upstream side of the upstream side pull roller in the web running direction and a control means connected to the tension detector and adapted to control the serve-motor so that a rotational speed of the upstream side pull roller is controlled in response to a signal detected by the tension detector. The upstream side pull roller has a rotational shaft to which a rotational shaft of the downstream side pull roller is mechanically connected.

There are further disposed an upstream side guide means and a downstream side guide means. The upstream side guide means includes a pair of guide rollers between which the upstream side pull roller is arranged and the downstream side guide means includes a pair of guide rollers between which the downstream side pull roller is arranged.

According to the characters and structures of the turn bar apparatus of the present invention mentioned above, the running web is reversed, i.e. turned over, in position by the turn bar apparatus, and during this operation. The tension of the web at the position upstream side of the turn bar apparatus is cut by the upstream side pull roller and the tension of the web, due to the resistance of the turn bar apparatus, is cut by the downstream side pull roller. The peripheral speeds of both the pull rollers are adjusted by the speed changing mechanisms. Furthermore, in the arrangement in which the speed changing mechanisms are minutely adjusted in speed by the servo-motors, the rotational speeds of the pull rollers are adjusted in response to the tensions detected by the tension detectors disposed on the upstream sides of the respective pull rollers. Accordingly, the changes of the tensions due to the running resistance of the web caused by the use of the turn bar apparatus can be effectively prevented.

The nature and further characteristic features of the present invention will be made more clear from the following descriptions made with reference to the accompanying drawings.

DESCRIPTION OF THE PREFERRED EMBODIMENTS

Preferred embodiments of the present invention will be described hereunder with reference to the accompanying drawings.

Figure 1:
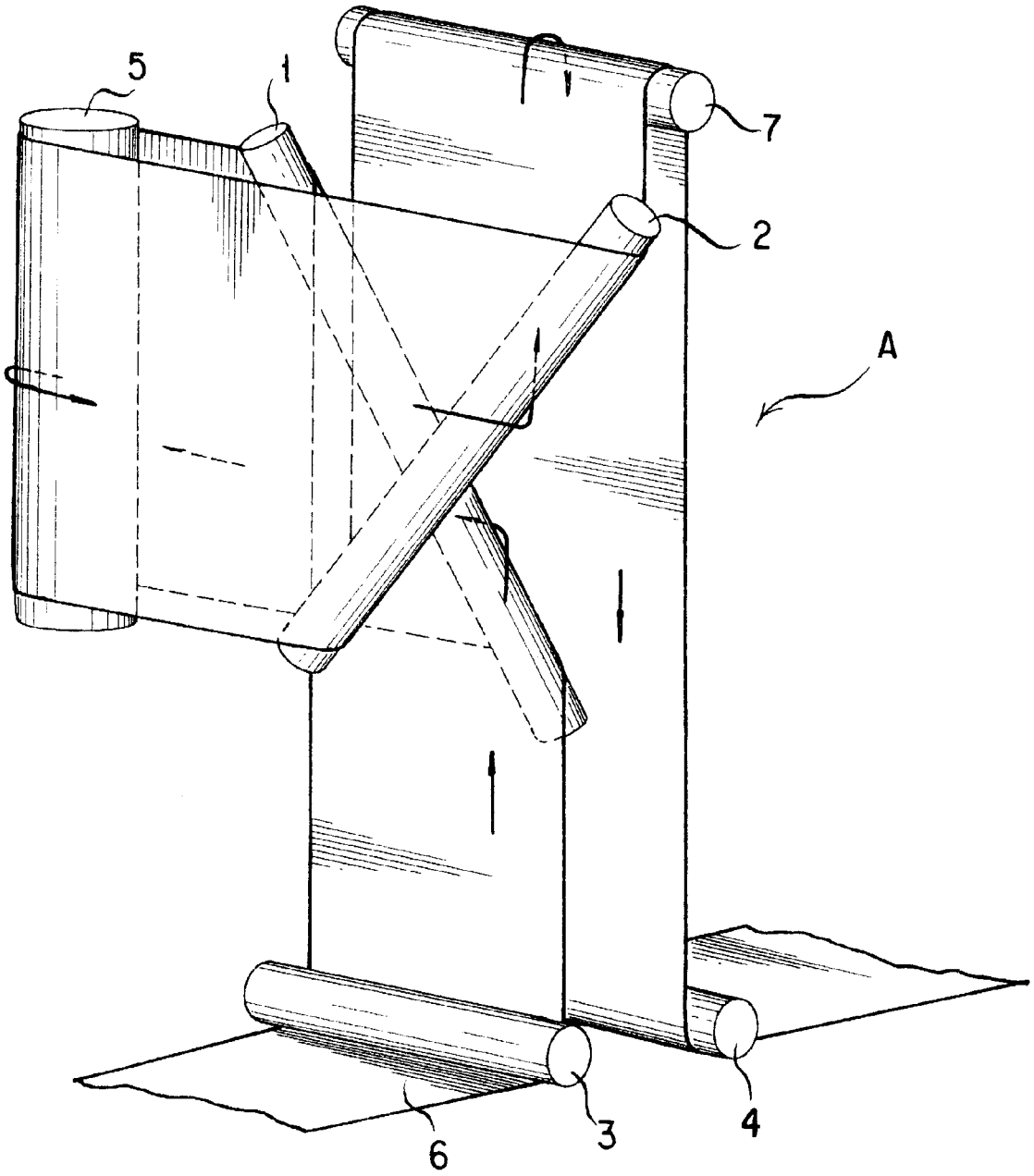
FIG. 1 is a schematic perspective view of a turn bar apparatus having a conventional structure.

FIGS. 2 to 6 represent a first embodiment of the turn bar apparatus of the present invention, in which like reference numerals are added to elements or members corresponding to those shown in FIG. 1 and the descriptions thereof are omitted herein.

Figure 2:
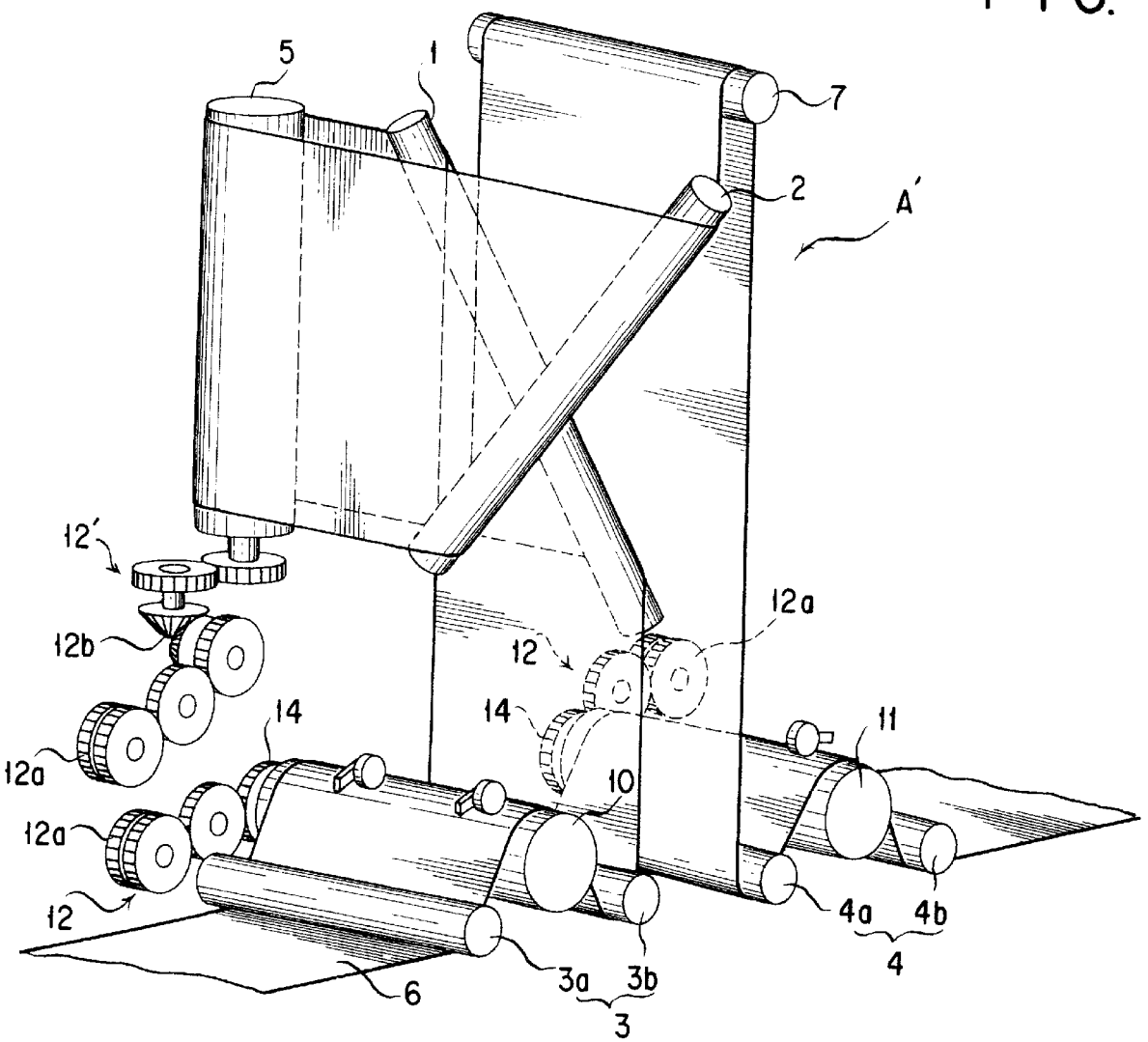
FIG. 2 is a schematic perspective view of a turn bar apparatus of a first embodiment according to the present invention.
Figure 3:
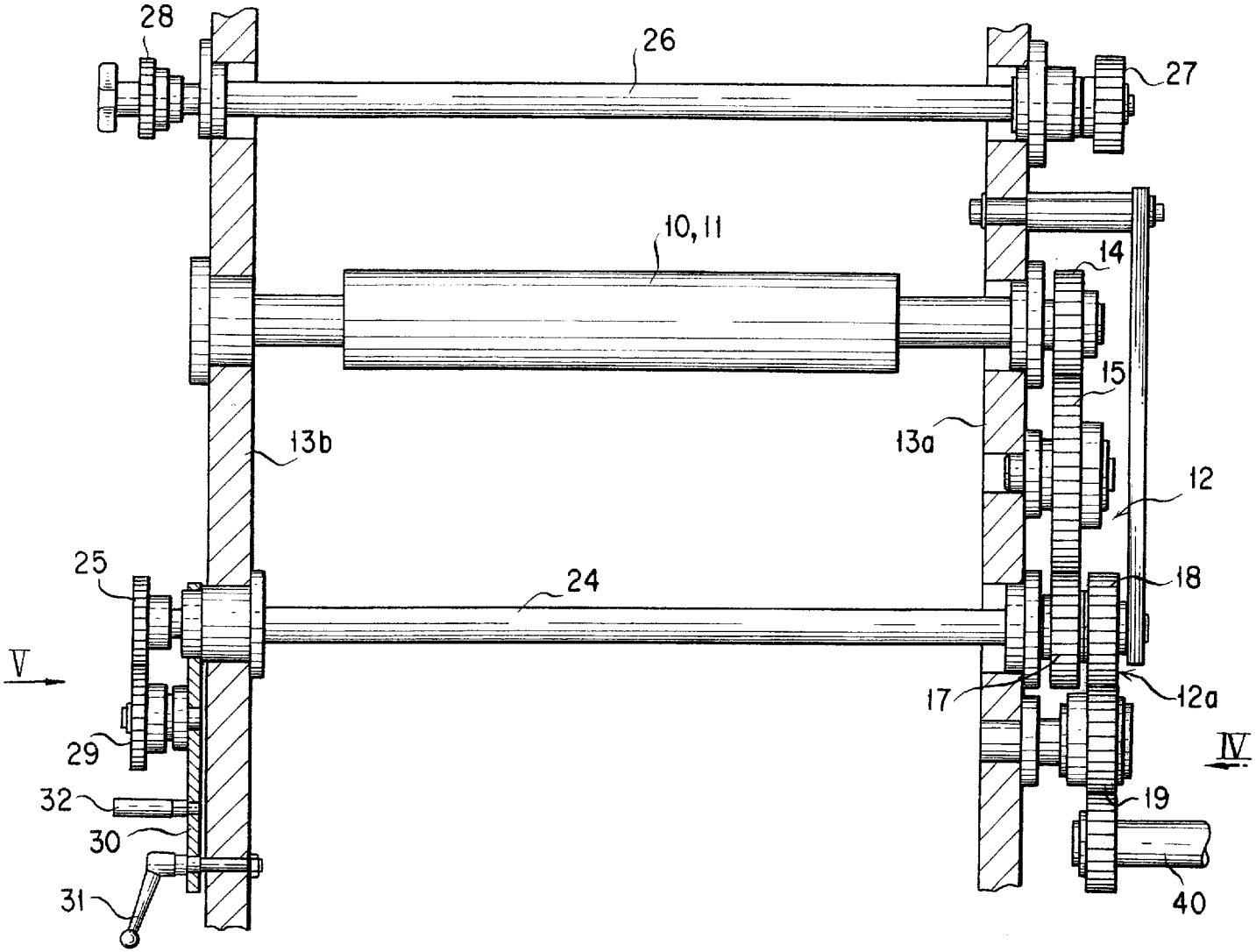
FIG. 3 is a view, partially in section, of a power transmission device of the turn bar apparatus of the first embodiment.

With reference to FIG. 2, a turn bar apparatus A' includes an upstream side guide roller unit 3 disposed on the upstream side of an upstream side turn bar 1, and the upstream side guide roller unit 3 is composed of first and second guide rollers 3*a* and 3*b* separated from each other in the running direction of the web 6. The turn bar apparatus A' also includes a downstream side guide roller unit 4 disposed to the downstream side of a downstream side turn bar 2, and the downstream side guide roller unit 4 is composed of first and second guide rollers 4*a* and 4*b* separated from each other in the running direction of the web 6. Both the turn bars 1 and 2 have inner hollow structures, as like in the conventional structure, provided with a number of holes through which air is blown out, or sheets having a low friction resistance are wound around the surfaces of the turn bars so as to allow the web 6 to be smoothly run around the turn bars 1 and 2.

An upstream side pull roller 10 and a downstream side pull roller 11 are disposed between the first and second guide rollers 3*a* and 3*b* of the upstream side guide roller unit 3 and between the first and second guide rollers 4*a* and 4*b* of the downstream side guide roller unit 4, respectively. These pull rollers 10 and 11 are arranged so as to pull out the web 6 in U-shape from the guide rollers 3*a* and 3*b* and the guide rollers 4*a* and 4*b,* respectively.

The pull rollers 10 and 11 are coupled to a prime motive shaft, after mentioned through a transmission device 12 so as to be rotated with peripheral speeds slightly higher than the running speed of the web 6. The peripheral speed of the pull roller will be made higher than the web running speed by making the roller diameter large with respect to the rotation number (constant) thereof, or a speed changing device such as speed changing gear mechanism 12*a* is utilized, as shown in FIG. 2, as part of the transmission device 12 which is coupled to the prime motive shaft which is connected to the pull rollers 10 and 11. In this first embodiment, the intermediate roller 5 is also coupled to a prime motive shaft through a speed changing gear mechanism 12*a* as a transmission device 12' which is the transmission device similar to 12 of the pull rollers. The intermediate roller 5 is also rotated with a variable peripheral speed that is slightly higher than the running speed of the web 6. Further, a bevel gear mechanism 12*b* is interposed between the intermediate roller 5 and the speed changing gear mechanism 12*a* to change the power transmission direction.

The speed changing gear mechanism 12*a* is connected to the respective pull rollers 10 and 11 are shown in detail in FIGS. 3 to 6.

The pull rollers 10 and 11 are rotatably supported by frame members 13*a* and 13*b* at both longitudinal end portions thereof, and driven gears 14 are secured to one of the ends of the shafts of the respective pull rollers 10 and 11. The speed changing gear mechanism 12*a* includes an output gear 17 which is operatively connected to the driven gear 14 through an intermediate gear 15. As the speed changing gear mechanism 12*a,* a Harmonic Drive (Commercial Product Name) of a known differential type speed changing device is used, and the Harmonic Drive includes an input gear 18 with which a drive gear 19, coupled to the prime motive shaft 40, is meshed.

Figure 6:
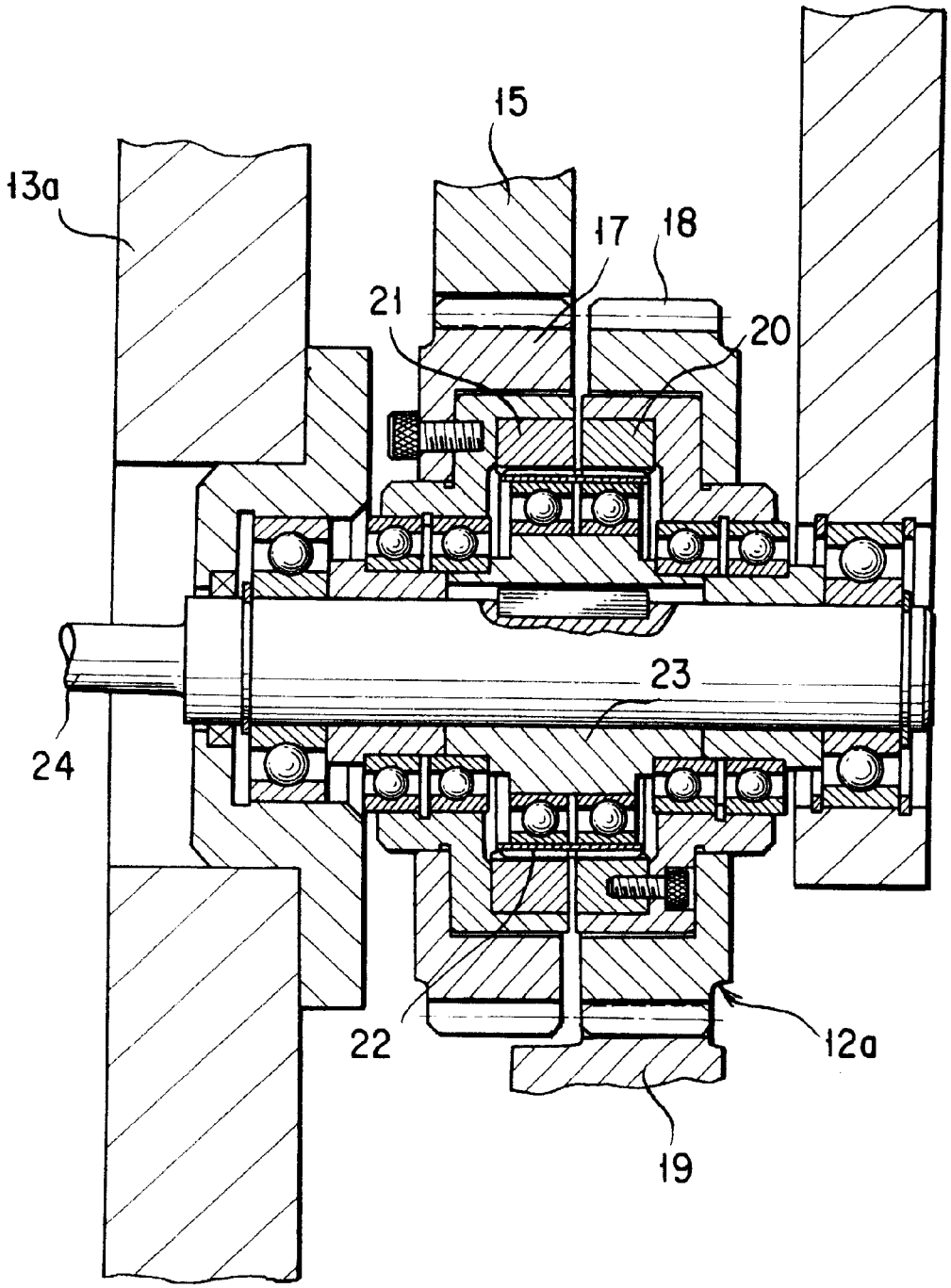
FIG. 6 is a sectional view showing one example of a power transmission device of the first embodiment.

With reference to FIG. 6, which shows the speed changing gear mechanism 12*a,* the rotation of the input gear 18 is transmitted to the output gear 17 through a circular spline 20, a flexible spline 22 and a dynamic spline 21 in this order. In this transmission of rotation, the rotation of the output gear 17 is changed in its rotational speed by changing a rotation number of a web generator 23 which supports the flexible spline 22. That is, the rotational speed of the output gear 17 is reduced as the rotational speed of the web generator 23 is made faster, and, on the other hand, the rotational speed of the output gear 17 is made faster as the rotational speed of the web generator 23 is reduced.

Figure 4:
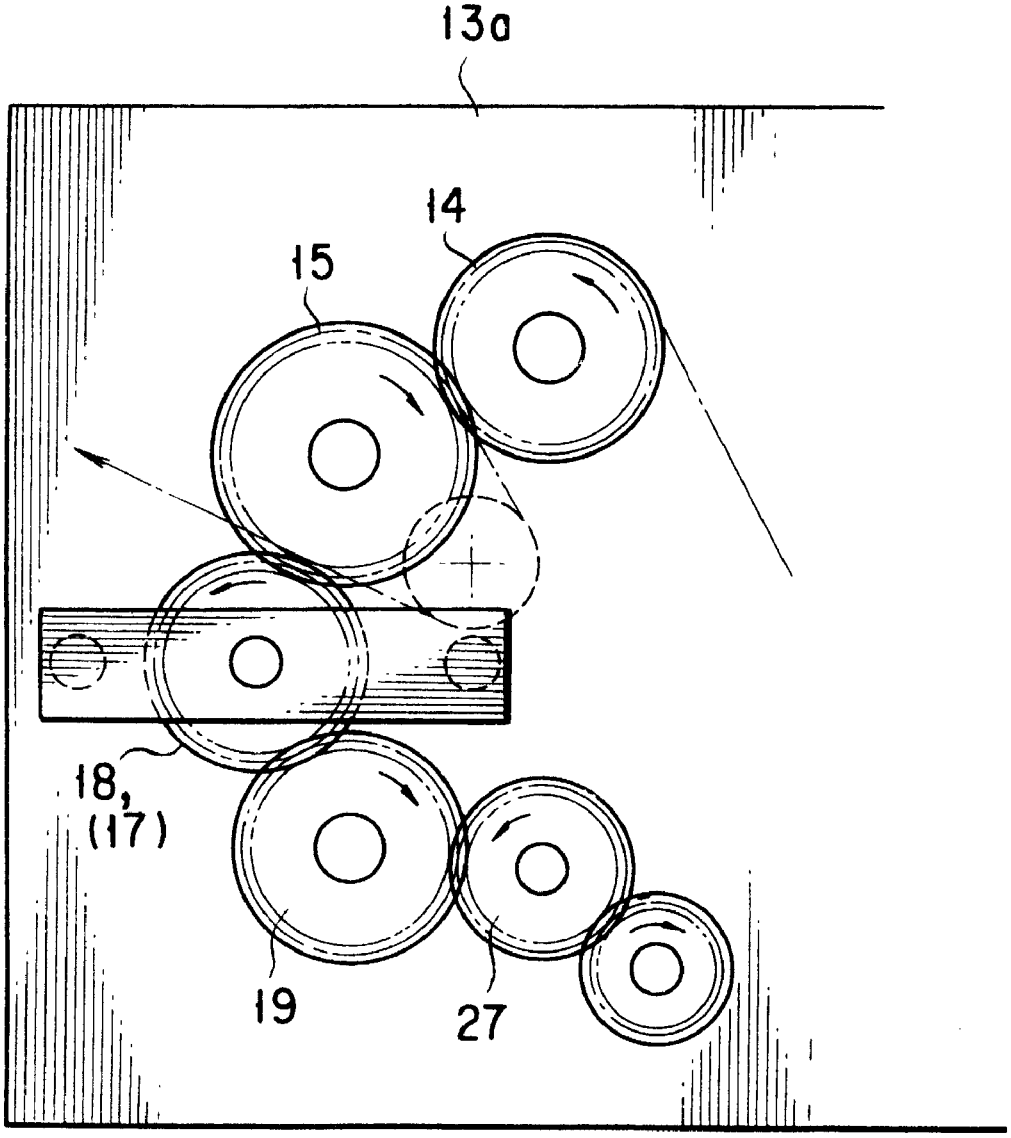
FIG. 4 is a schematic view viewed from a direction IV in FIG. 3.
Figure 5:
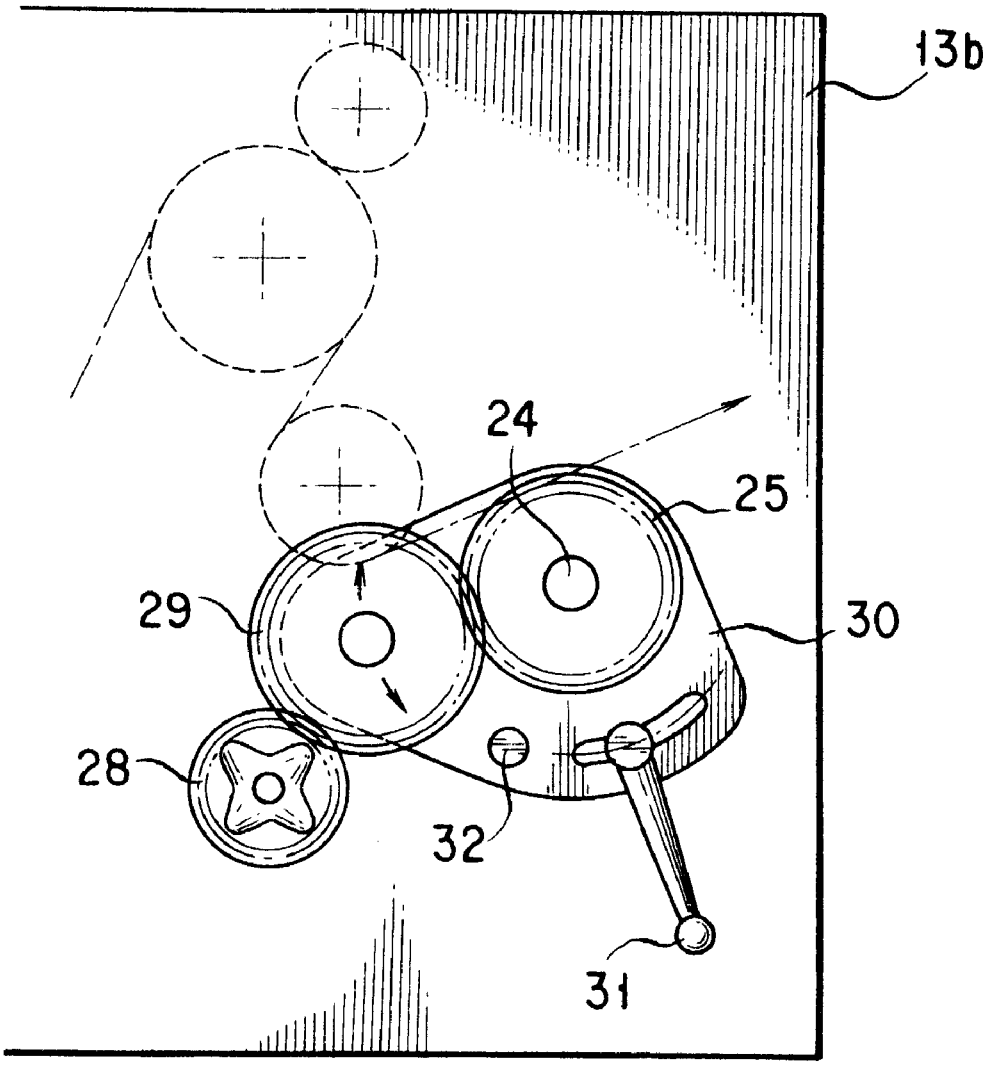
FIG. 5 is a schematic view viewed from a direction V in FIG. 3.

One end of a rotational shaft 24 for speed changing supported by the frame members 13*a* and 13*b* is fixed to the web generator 23, and a driven gear 25 is fixed to the other end of the rotational shaft 24. Further, an intermediate shaft 26 is also supported by the frame members 13*a* and 13*b*. As shown in FIG. 4, the intermediate shaft 26 has one end connected to a driven gear 27, which is meshed with the driving gear 19 which is meshed with the input gear 18 of the speed changing gear mechanism 12*a*. The other end of intermediate shaft 26 is connected to a gear 28 which is detachably mounted for changing the speed. The gear 28 is meshed with the driven gear 25 secured to the other end of the rotational shaft 24 through an intermediate gear 29 as shown in FIG. 5.

The intermediate gear 29 is supported, by a rotary plate 30, which is supported by the frame member 13*b*, so as to be coaxial and rotatable with the rotational shaft 24 for speed changing. The rotary plate 30 is fixed in a predetermined position by means of a fastening handle 31 and is rotated by a grip 32.

The speed changing rotational shaft 24 secured to the web generator 23 of the speed changing gear mechanisms 12*a*, 12*a* is rotated by means of the speed changing gear 28 of the intermediate shaft 26, the intermediate gear 29 and the driven gear 25. The rotation number of the speed changing rotational shaft 24 may be changed by exchanging the speed changing gear 28 with another one having different gear numbers. At this time, the change of a distance between the shafts of the transmission system can be absorbed by changing the position of the intermediate gear 29 through the rotation of the rotary plate 30. In accordance with the manner mentioned above, the rotational number of the output gear 17 of the speed changing gear mechanisms 12*a*, 12*a* can be optionally minutely changed by exchanging the speed changing gear 28 with another one.

In the arrangement of the turn-bar apparatus mentioned above, the respective elements or members of a printing machine are operated in response to the rotation of the prime motive shaft 40 of the printing machine, and accordingly, the web 6 is run at a predetermined speed. The web 6 is reversed in position by the upstream side turn bar 1, the downstream side turn bar 2 and the intermediate roller 5 during the passing through the turn bar apparatus A'.

During this running of the web 6, the rotating speeds of both the pull rollers 10 and 11 disposed at the upstream side and downstream side of the turn bar apparatus A' are regulated by operating the speed changing gear mechanisms 12*a*, 12*a* so that the peripheral speeds of both the pull rollers 10 and 11 are slightly faster than the running speed of the web 6. Furthermore, the rotating speed of the intermediate roller 5 is also regulated by operating the speed changing gear mechanism 12*a* so that the peripheral speed of the intermediate roller 5 is substantially equal to or slightly faster than the running speed of the web 6.

In a case where any speed changing mechanism is not used as the driving device 12 for the pull rollers 10 and 11, the outer diameters of both the pull rollers 10 and 11 are made larger without changing the rotating speeds thereof so that the peripheral speeds of the pull rollers 10 and 11 are made faster than the web running speed. Further, the intermediate roller 5 may be made to be freely rotatable.

According to the operation mentioned above, the tension acting on the upstream side of the turn-bar apparatus A' is cut by the pull roller 10 disposed on the upstream side of the turn bar apparatus A'. And, on the other hand, the tension generated by the resistance of the turn bar apparatus A' is cut by the pull out roller 11 disposed on the downstream side thereof. Furthermore, since the pull rollers 10 and 11 are operatively coupled to the prime drive shaft 40 through the speed changing mechanisms, the pulling rate (strength) can be changed in response to the change of thicknesses of the webs to be used to thereby obtain the most suitable pulling strength with respect to the various webs having different thicknesses.

In the first embodiment of the turn bar apparatus mentioned above, the rotational shaft 24 for speed changing for adjusting the rotational speeds of the pull rollers 10 and 11 and the intermediate roller 5 is coupled to the prime motive shaft 40 through the speed changing gear 28, which is detachably mounted so as to be manually exchangeable with another one to thereby change the rotational speed thereof. However, in a second embodiment mentioned below, as shown in FIG. 7, the rotating speeds of the respective speed changing rotational shafts may be changed in a stepless manner by means of servo-motors 33*a*, 33*b* and 33*c*.

In this second embodiment, tension detectors 34*a*, 34*b* and 34*c* are arranged in positions corresponding to the guide rollers 3*a*, 3*b* and 4*a* disposed upstream of the pull rollers 10 and 11 and the intermediate roller 5 so as to detect tensions of the web 6 at these positions. The servo-motors 33*a*, 33*b* and 33*c* are then controlled so that the pulling forces corresponding to the tensions of the web 6 at these positions are applied to the pull rollers 10 and 11 and the intermediate roller 5, respectively.

Figure 7:
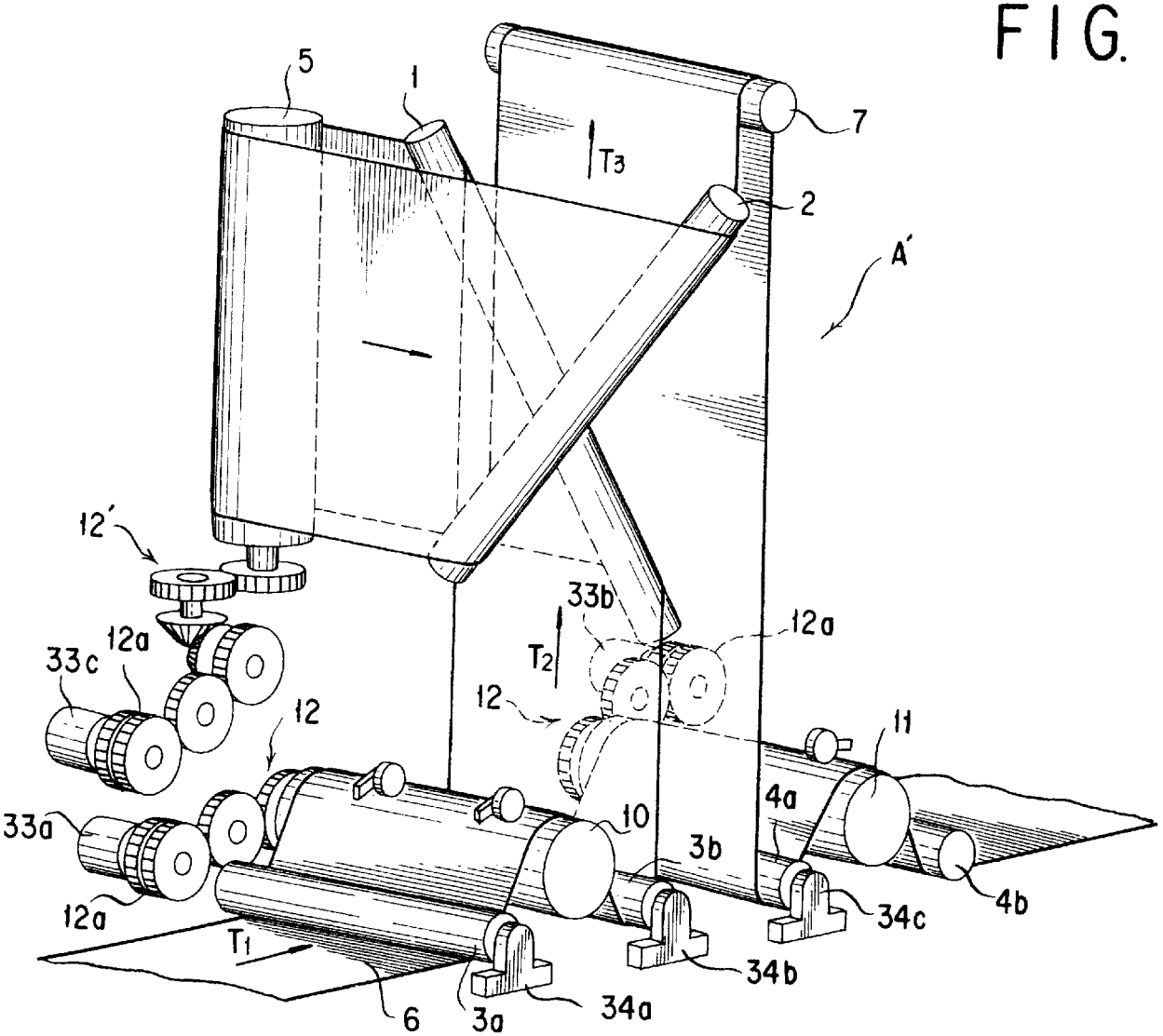
FIG. 7 is a schematic perspective view of a turn bar apparatus of a second embodiment according to the present invention.
Figure 8:
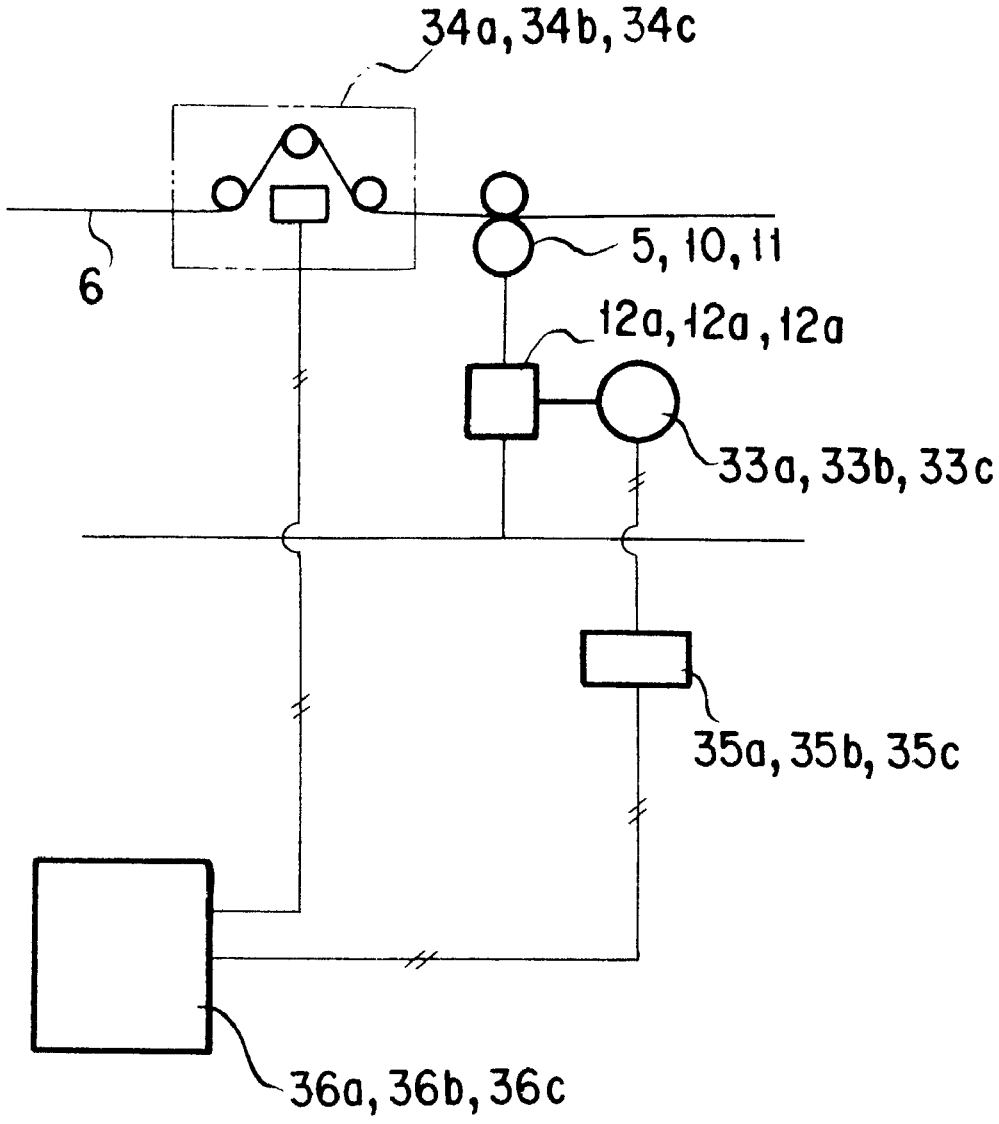
FIG. 8 is a diagram showing a structure of a power transmission device of the second embodiment.

FIG. 8 shows a transmission device utilizing the tension detectors 34*a*, 34*b* and 34*c* and the servo-motors 33*a*, 33*b* and 33*c* of the arrangement shown in FIG. 7. The respective servo-motors 33*a*, 33*b* and 33*c* are controlled by controllers 36*a*, 36*b* and 36*c* through motor drivers 35*a*, 35*b* and 35*c*, respectively. The controllers 36*a*, 36*b* and 36*c* are operatively connected to the tension detectors 34*a*, 34*b* and 34*c* so that signals representing the detected values of the tension detectors 34*a*, 34*b* and 34*c* are inputted into the controllers 36*a*, 36*b* and 36*c*, respectively, and the controllers 36*a*, 36*b* and 36*c* generate output signals in response to these input signals to the motor drivers 35*a*, 35*b* and 35*c*, respectively.

According to the structures or arrangements mentioned above, the rotational speeds of the pull rollers 10 and 11 and the intermediate roller 5 can be automatically minutely controlled in a stepless manner by means of the controllers 36*a*, 36*b* and 36*c*, respectively.

In this second embodiment, in which the rotational speeds of the speed changing rotational shafts are changed respectively by means of the servo-motors, the following modified arrangement may be adopted. That is, only one tension detector 34*a* is disposed in a position opposing to an upstream side portion of the pull roller 10 disposed to the upstream side of the turn has apparatus A', and the rotating speed of the pull roller 10 is automatically controlled by the servo-motor 33*a* and the speed changing mechanism 12*a* for the pull roller 10 by means of the signal from the tension detector 34*a* so that the tension T1 of the web 6 running through a portion further upstream of the pull roller 10 is set to a predetermined tension. According to this modified arrangement, the other servo-motors 33*b* and 33*c* of the intermediate roller 5 and the downstream side pull roller 11 will be controlled in response to the servo-motor 33*a* of the upstream side pull roller 10.

In this arrangement, tensions T2 and T3 of the web 6 at the upstream sides of the intermediate roller 5 and the downstream side pull roller 11 will be controlled in definite proportion with respect to the tension T1 of the web 6 at the most upstream side so as to have values equal to or slightly larger than the tension T1.

Figure 9:
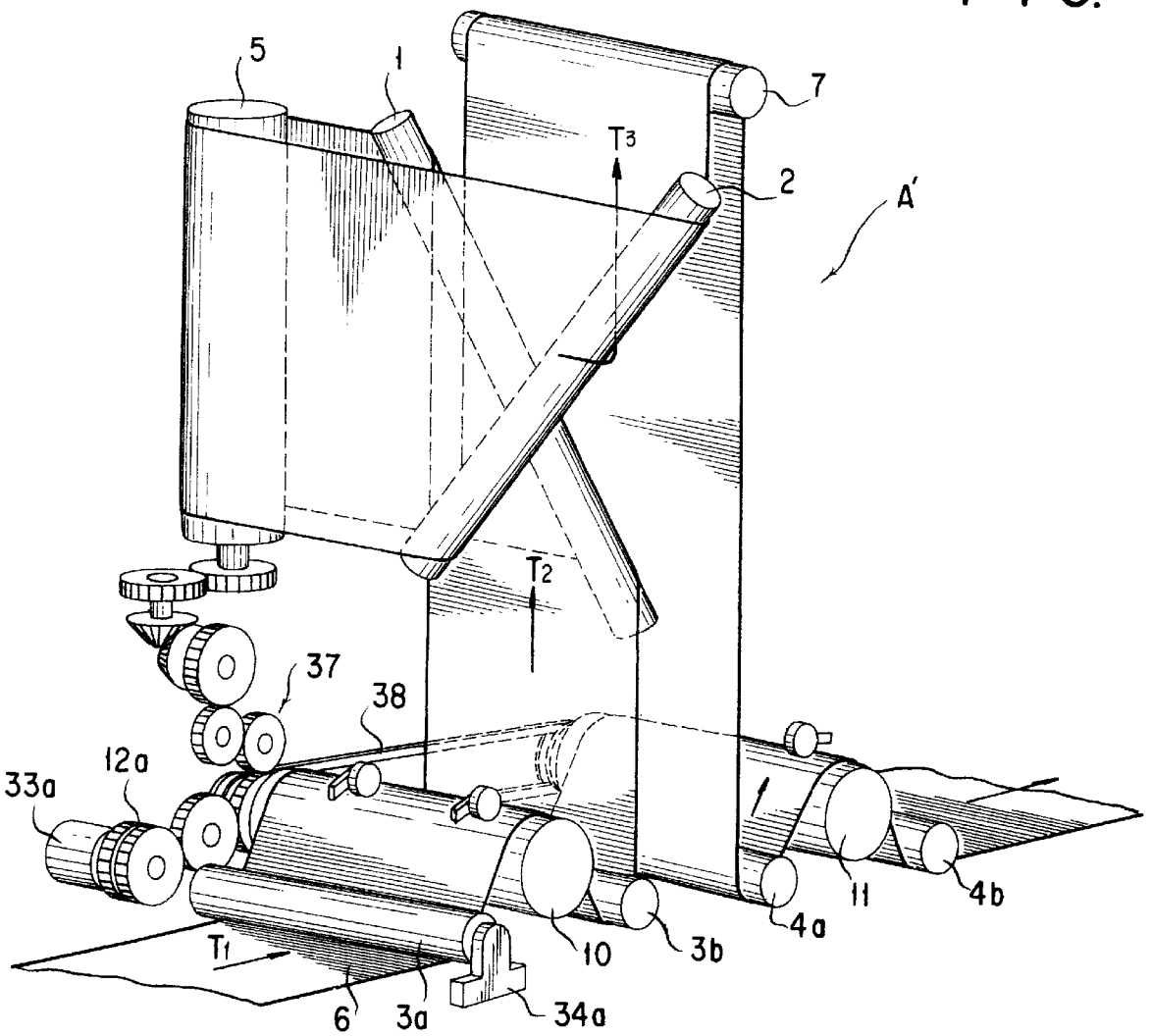
FIG. 9 is a schematic perspective view of a turn bar apparatus of a third embodiment according to the present invention.

FIG. 9 represents a third embodiment of the present invention.

In this third embodiment, only the upstream side pull roller 10 is controlled by means of the servo-motor 33*a* through the rotational shaft and the speed changing mechanism 12*a* of the pull roller 10, and the intermediate roller 5 and the downstream side roller 11 are operatively connected to the rotational shaft of the upstream side pull roller 10 through a gear train 37 and a timing belt 38. In this arrangement, the intermediate roller 5 and the downstream side pull roller 11 are rotated in synchronism with the rotation of the upstream side pull roller 10, and the tensions T2 and T3 at the upstream sides of the intermediate roller 5 and the downstream side pull roller 11 are set in accordance with the tension T1 at the most upstream side portion.

According to the present invention, as mentioned above, at a time when the turn bar apparatus A' is operated and the web 6 is reversed in position, the tension of the web at the upstream side in the web running direction is reduced by the upstream side pull roller 10 of the turn bar apparatus A', and furthermore, the tension of the web 6 due to the resistance of the turn bar apparatus A' is also reduced by the downstream side pull roller 11 of the turn bar apparatus A'. Accordingly, the changing of the tension of the web 6 due to the turn bar apparatus A' can be cancelled and, hence, the printing sections on the upstream and downstream sides of the turn bar apparatus A' are not adversely affected. Thus, the aberrations of the registerings in the printing operation at the upstream and downstream side printing sections can be significantly prevented and the printing registering at those printing sections can be stabilized.

Furthermore, since the pull rollers 10 and 11 are coupled to the main driving shaft through the speed changing mechanisms, the pulling rates of the pull rollers 10 and 11 can be changed in response to the change of the thickness of the web 6. Accordingly, the most suitable pulling rates can be obtained with respect to the webs having different thicknesses.

Still furthermore, according to the arrangement in which the rotating speeds of the pull rollers 10 and 11 can be adjusted in response to the tensions at the upstream sides of these pull rollers, the pulling rates thereof can be automatically changed in response to the tension acting on the web 6, and hence, the registering in the printing operation at the upstream and downstream side printing sections can be made further stable.

Further, it is self-evident to a person skilled in the art that although the present invention is described hereinbefore with reference to the exemplary embodiments, it is possible to make various changes, deletions and additions to the disclosed embodiment without departing from the subject and scope of the present invention. Accordingly, it is to be understood that the present invention is not limited to the described embodiments and includes the scope or its equivalent scope defined by the elements recited in the appended claims.

What is claimed is:

1. A turn bar apparatus for reversing the position of a web during running thereof in a rotary press, said turn bar apparatus comprising:

an upstream side turn bar and a downstream side turn bar disposed upstream and downstream along a web running direction, respectively;

an upstream side pull roller disposed upstream of said upstream side turn bar;

a downstream side pull roller disposed downstream of said downstream side turn bar, wherein said upstream and downstream side pull rollers are capable of being rotated at peripheral speeds which are faster than a running speed of the web so as to pull the web;

an intermediate roller disposed between said upstream side turn bar and downstream side turn bar, wherein said intermediate roller is capable of being rotated at a peripheral speed which is faster than a running speed of the web in order to pull the web; and a prime motive shaft, wherein said upstream side pull roller is connected to said prime motive shaft via a first speed changing mechanism and said downstream side pull roller is connected to said prime motive shaft via a second speed changing mechanism.

2. A turn bar apparatus as claimed in claim 1, wherein said first and second speed changing mechanisms are comprised of gear arrangements, respectively.

3. A turn bar apparatus for reversing the position of a web during running thereof in a rotary press, said turn bar apparatus comprising:

an upstream side turn bar and a downstream side turn bar disposed upstream and downstream along a web running direction, respectively;

an upstream side pull roller disposed upstream of said upstream side turn bar;

a downstream side pull roller disposed downstream of said downstream side turn bar, wherein said upstream and downstream side pull rollers are capable of being rotated at peripheral speeds which are faster than a running speed of the web so as to pull the web;

an intermediate roller disposed between said upstream side turn bar and downstream side turn bar, wherein said intermediate roller is capable of being rotated at a peripheral speed which is faster than a running speed of the web in order to pull the web;

a first differential speed changing mechanism connected to said upstream side pull roller;

a first servo-motor connected to said first differential speed changing mechanism;

a second differential speed changing mechanism connected to said intermediate roller;

a second servo-motor connected to said second differential speed changing mechanism;

a third differential speed changing mechanism connected to said downstream side pull roller;

a third servo-motor connected to said third differential speed changing mechanism;

a first tension detector for detecting tension of the web at a position upstream of said upstream side pull roller;

a second tension detector for detecting tension of the web at a position upstream of said downstream side pull roller;

a third tension detector for detecting tension of the web at a position upstream of said intermediate roller; and control means connected to said first, second, and third tension detectors and adapted to control said first, second, and third servo-motors so that rotational speeds of said pull rollers are controlled in response to signals from said tension detectors.

4. A turn bar apparatus for reversing the position of a web during running thereof in a rotary press, said turn bar apparatus comprising:

an upstream side turn bar and a downstream side turn bar disposed upstream and downstream along a web running direction, respectively;

an upstream side pull roller disposed upstream of said upstream side turn bar;

a downstream side pull roller disposed downstream of said downstream side turn bar, wherein said upstream and downstream side pull rollers are capable of being rotated at peripheral steeds which are faster than a running speed of the web so as to pull the web;

an intermediate roller disposed between said upstream side turn bar and downstream side turn bar, wherein said intermediate roller is capable of being rotated at a peripheral speed which is faster than a running speed of the web in order to pull the web;

a differential speed changing mechanism connected to said upstream side pull roller, wherein said upstream side pull roller has a rotational shaft which is mechanically connected to a rotational shaft of said downstream side pull roller;

a servo-motor connected to said differential speed changing mechanism for controlling the speed of said upstream side pull roller;

a prime motive shaft connected to said upstream side pull roller via said differential speed changing mechanism;

a tension detector, disposed upstream of said upstream side roller, for detecting tension of the web; and a control means operably connected to said tension detector and adapted to control said servo-motor such that a rotational speed of said upstream side pull roller is controlled in response to a signal from said tension detector.

* * * * *